US006945239B2

(12) United States Patent
Moser et al.

(10) Patent No.: US 6,945,239 B2
(45) Date of Patent: Sep. 20, 2005

(54) METHOD AND DEVICE FOR OPERATING AN INTERNAL COMBUSTION ENGINE

(75) Inventors: Eduard Moser, Ludwigsburg (DE); Ahmet Bas, Zell (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/916,078

(22) Filed: Aug. 10, 2004

(65) Prior Publication Data

US 2005/0061304 A1 Mar. 24, 2005

(30) Foreign Application Priority Data

Aug. 28, 2003 (DE) ..... 103 40 062

(51) Int. Cl.[7] ..... F02B 47/08
(52) U.S. Cl. ..... 123/568.2
(58) Field of Search ..... 123/568.2, 568.11, 123/568.18, 568.26, 568.27, 559.1, 559.2, 561, 562; 60/605.2

(56) References Cited

U.S. PATENT DOCUMENTS 6,321,537 B1 * 11/2001 Coleman et al. ..... 60/612
6,360,732 B1 * 3/2002 Bailey et al. ..... 123/568.12
6,422,222 B1 * 7/2002 Arbeiter et al. ..... 123/568.2
6,484,499 B2 * 11/2002 Coleman et al. ..... 60/612

* cited by examiner

*Primary Examiner*—Mahmoud Gimie
(74) *Attorney, Agent, or Firm*—Kenyon & Kenyon

(57) ABSTRACT

A method and a device for operating an internal combustion engine make it possible to set a setpoint value for the overall fresh air mass flow as the top control target. The internal combustion engine has a multi-flow air system including a multi-channel air supply and a corresponding multi-channel exhaust gas discharge, exhaust gas being recirculated from the multi-channel exhaust gas discharge into the multi-channel air supply and the exhaust gas recirculation being regulated for setting a setpoint fresh air mass flow. A value for the required overall fresh air mass flow of the internal combustion engine is predefined for at least one exhaust gas recirculation channel as the setpoint for the exhaust gas regulation.

4 Claims, 3 Drawing Sheets

METHOD AND DEVICE FOR OPERATING AN INTERNAL COMBUSTION ENGINE

BACKGROUND INFORMATION

It is known that large diesel engines in particular are increasingly equipped with dual-flow air systems. Two turbochargers compress the two fresh air mass flows into one combined boost pressure. The exhaust gas mass flows drive the turbines of both turbochargers. An appropriate multi-channel air supply and an appropriate multi-channel exhaust gas discharge are provided in such a dual-flow or multi-flow air system. The exhaust gas is recirculated from the multi-channel exhaust gas discharge into the multi-channel air supply, and the exhaust gas recirculation is regulated for setting a setpoint fresh air mass flow.

Standard methods enable either a) the adjustment of the fresh air mass flow required for meeting the emission standard by activating the exhaust gas recirculation valves in the exhaust gas recirculation channels in an identical way or b) the adjustment of the individual air paths or air channels to the same overall proportion of the fresh air mass flow, in the case of a dual-flow air system to one half of the total fresh air mass flow. In theory, i.e., in the ideal case, involving balanced air paths or air channels and the same behavior of the exhaust gas recirculation valves, the emission standard is met and, simultaneously, an equal air mass flow is achieved in the existing air paths or air channels. In practice, all multi-flow air systems are asymmetrical and, as a rule, the exhaust gas recirculation valves exhibit different behaviors, e.g., due to manufacturing tolerances or aging. In case a), this results in unequal air mass flows in the individual air paths or air channels, which results in very low turbocharger rotational speeds. This in turn results in very poor startup behavior or in low agility. In contrast, in case b), the total setpoint (fresh) air mass flow is not achieved in border areas. In a dual-flow air system, a first controller for the exhaust gas recirculation of a first air channel or air path, for example, is operated within the limit of a manipulated variable in this case, and a second controller for the exhaust gas recirculation of a second air channel or air path regulates one half of the total setpoint (fresh) air mass flow required by it.

SUMMARY OF THE INVENTION

The method according to the present invention and the device according to the present invention for operating an internal combustion engine have the advantage over the related art that a value for the required total fresh air mass flow of the internal combustion engine is predefined as the setpoint value for the exhaust gas recirculation regulation for at least one exhaust gas recirculation channel. It is ensured in this way that a setpoint value for the total fresh air mass flow is achieved, thereby meeting the emission standards even in the presence of unequal air paths or air channels, or unequal exhaust gas recirculation valves, e.g., due to manufacturing tolerances or aging. Within this scope, optimum air mass equalization is aimed at in a manner known to those skilled in the art, in order to limit the agility loss.

It is particularly advantageous if the value for the required total fresh air mass flow is predefined as the setpoint value for the exhaust gas recirculation regulation for the at least one exhaust gas recirculation channel in the event when a predefined setpoint value for the fresh air mass flow is not achieved in another exhaust gas recirculation channel. In this way, the standard method mentioned above under b) may be used. Only when the predefined overall proportion of the fresh air flow is no longer achieved by one of the air paths or air channels because the exhaust gas recirculation valve of the assigned exhaust gas recirculation channel is operated in the flow limiting mode, for example, is the achievement of a setpoint value for the overall fresh air mass flow impressed on the regulator of at least one other air path as the new control target for the exhaust gas recirculation regulation of the assigned exhaust gas recirculation channel.

It is a further advantage when the value for the required overall fresh air mass flow of the internal combustion engine is predefined as the setpoint value for the exhaust gas recirculation regulation for the at least one exhaust gas recirculation channel in the event when an error is detected at an actuator or at a sensor in one of the control loops for the exhaust gas recirculation regulation. In this way, the standard method mentioned above under b) may initially also be used. Only when an error is detected at an actuator, an exhaust gas recirculation valve for example, or at a sensor, an air mass flow rate sensor for example, in one of the control loops for the exhaust gas recirculation regulation, is the achievement of a setpoint value for the overall fresh air mass flow impressed on the controller of at least one air path as the new control target for the exhaust gas recirculation regulation of the assigned exhaust gas recirculation channel.

DETAILED DESCRIPTION

Figure 1:
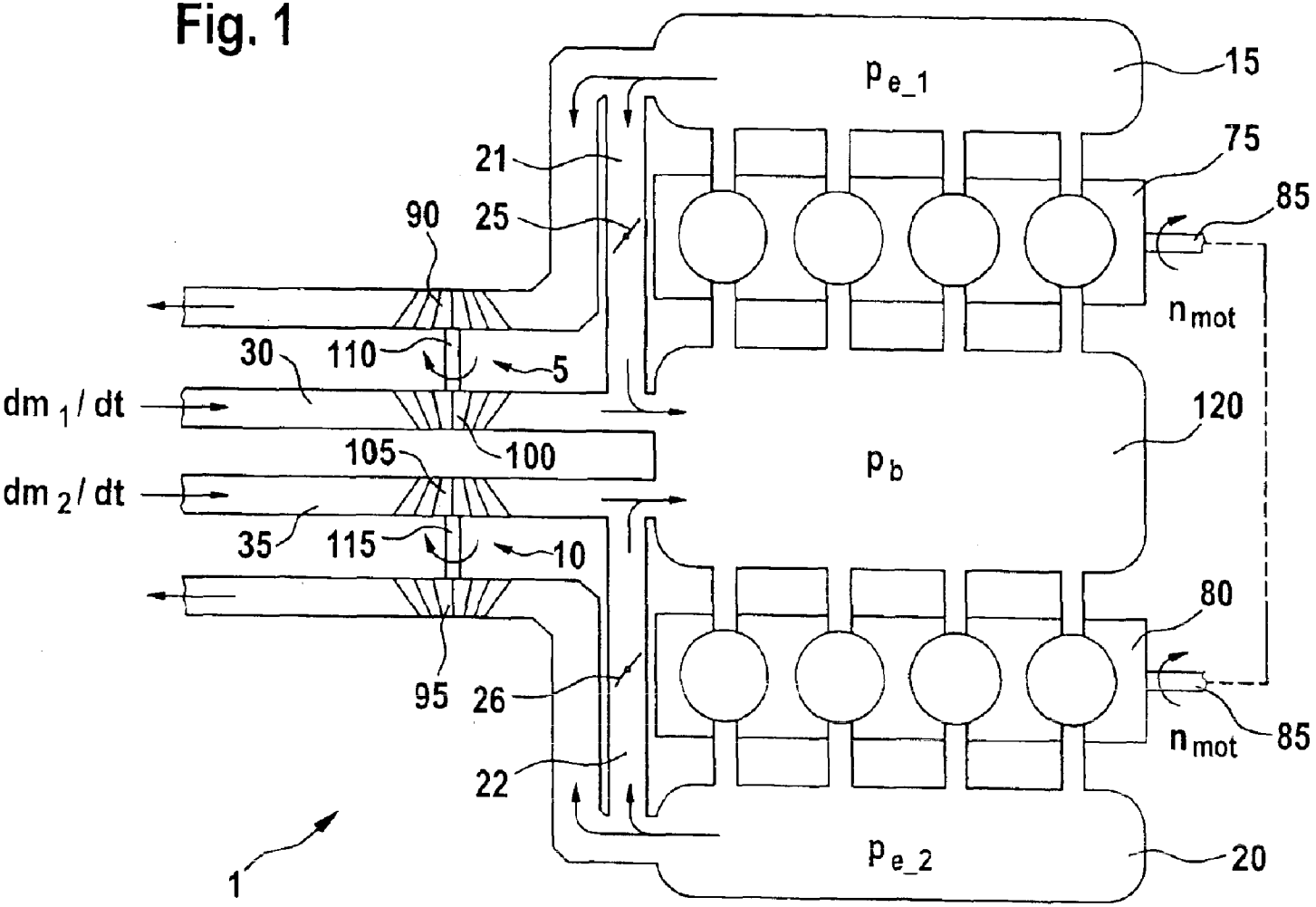
FIG. 1 shows a schematic view of an internal combustion engine having a dual-flow air system.

In FIG. 1, 1 designates an internal combustion engine, in a motor vehicle for example. Internal combustion engine 1 includes a first engine bank 75 and a second engine bank 80. First engine bank 75 and second engine bank 80 may represent a diesel engine or a gasoline engine. Fresh air is supplied to both engine banks 75, 80 via a first air channel 30 and via a second air channel 35. A first air mass flow or fresh air mass flow dm1/dt supplied via first air channel 30 is compressed by a first compressor 100 of a first exhaust gas turbocharger 5. A second air mass flow or fresh air mass flow dm2/dt supplied via second air channel 35 is compressed by a second compressor 105 of a second exhaust gas turbocharger 10. Both fresh air mass flows dm1/dt and dm2/dt merge in a common air chamber 120 in which supercharging pressure pb prevails. Fresh air is supplied from common air chamber 120 to both engine banks 75, 80. According to the example in FIG. 1, engine banks 75, 80 each include four cylinders which are not identified in detail. Fresh air is distributed from common air chamber 120 into the combustion chambers of the individual cylinders. Furthermore, fuel is supplied to the combustion chambers of the individual cylinders either directly or via common air chamber 120. The air/fuel mixture, formed in this way in the combustion chambers, is ignited and drives a crankshaft 85 via the pistons of the cylinders in a manner known to those skilled in the art. The rotational speed of crankshaft 85 and thus the engine speed nmot may be determined using an rpm sensor (not shown in FIG. 1).

The exhaust gas formed during the combustion of the air/fuel mixture in the combustion chambers of first engine block (bank) 75 is discharged via a first exhaust gas channel 15. The exhaust gas formed during the combustion of the air/fuel mixture in the combustion chambers of second engine block 80 is discharged via a second exhaust gas channel 20. A first exhaust gas counterpressure pe_1 prevails in first exhaust gas channel 15. A second exhaust gas counterpressure pe_2 prevails in second exhaust gas channel 20. A first turbine 90 of first exhaust gas turbocharger 5, which drives first compressor 100 via a first shaft 110, is situated in first exhaust gas channel 15. A second turbine 95 of second exhaust gas turbocharger 10, which drives second compressor 105 via a second shaft 115, is situated in second exhaust gas channel 20.

The air system of internal combustion engine 1 having the two air channels 30, 35 and the two exhaust gas channels 15, 20 is a dual-flow system. First fresh air mass flow dm1/dt and second fresh air mass flow dm2/dt may be measured in first air channel 30 and in second air channel 35, respectively, using an air mass flow rate sensor (not shown in FIG. 1) or may be modeled in a manner known to those skilled in the art. Furthermore, a first actual exhaust gas counterpressure pe_1_actual in first exhaust gas channel 15 and a second actual exhaust gas counterpressure pe_2_actual in second exhaust gas channel 20 may be measured in first exhaust gas channel 15 and in second exhaust gas channel 20, respectively, using a pressure sensor (not shown in FIG. 1) or may be modeled in a manner known to those skilled in the art. Correspondingly, an actual boost pressure pb_actual may be measured in common air chamber 120 using a pressure sensor (not shown in FIG. 1) or may be modeled in a manner known to those skilled in the art.

A first exhaust gas recirculation channel 21 branches off from first exhaust gas channel 15 and meets first air channel 30 downstream from first compressor 100. A first exhaust gas recirculation valve 25 is situated in first exhaust gas recirculation channel 21. First exhaust gas recirculation valve 25 is controlled within the scope of a first exhaust gas recirculation regulator 50 (not shown in FIG. 1) to set a predefined first setpoint value for a fresh air mass flow to be supplied to air chamber 120 via first air channel 30. A second exhaust gas recirculation channel 22 branches off from second exhaust gas channel 20 and meets second air channel 35 downstream from second compressor 105. A second exhaust gas recirculation valve 26 is situated in second exhaust gas recirculation channel 22. Second exhaust gas recirculation valve 26 is controlled within the scope of a second exhaust gas recirculation regulator 55 (not shown in FIG. 1) to set a predefined second setpoint value for a fresh air mass flow to be supplied to air chamber 120 via second air channel 25.

Figure 2:
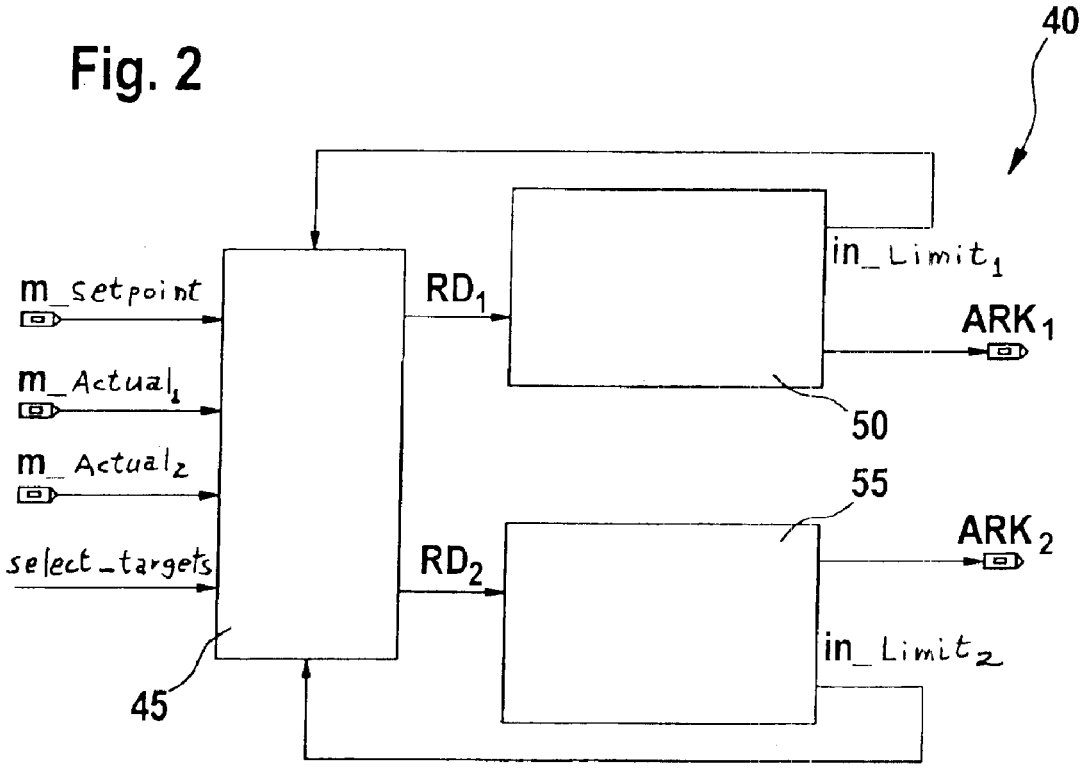
FIG. 2 shows a block diagram of a device according to the present invention.

FIG. 2 shows a block diagram of device 40 according to the present invention which may be implemented in the form of software and/or hardware in an engine controller of internal combustion engine 1 for example. First fresh air mass flow dm1/dt as a first actual value m_actual1 for the fresh air mass flow and second fresh air mass flow dm2/dt as a second actual value m_actual2 for the fresh air mass flow may be supplied to device 40 according to the present invention by the above-mentioned air mass flow rate sensors for example. Furthermore, a setpoint value m_setpoint for the fresh air mass flow, also referred to below as overall fresh air mass flow, to be supplied to air chamber 120 and thus to the combustion chambers of the individual engine banks 75, 80 is supplied to device 40. This setpoint value m_setpoint is determined in a manner known to those skilled in the art, for example as a function of a driver's intent or an accelerator pedal position. Device 40 includes a module 45 for dividing the control deviations, both actual values m_actual1, m_actual2 for the fresh air mass flow and the setpoint value m_setpoint for the overall fresh air mass flow being supplied to the module. In addition, module 45 is supplied by first exhaust gas recirculation regulator 50 with a first limiting signal in_limit1 which is set when first exhaust gas recirculation regulator 50 or first exhaust gas recirculation valve 25 are operated in the flow limiting mode; otherwise they are reset. The state of limitation of first exhaust gas recirculation regulator 50 or of first exhaust gas recirculation valve 25 is detected in a manner known to those skilled in the art and is indicated by first limiting signal in_limit1.

In addition, module 45 is supplied by second exhaust gas recirculation regulator 55 with a second limiting signal in_limit2, which is set when second exhaust gas recirculation regulator 55 or second exhaust gas recirculation valve 26 are operated in the limiting mode; otherwise they are reset. The state of limitation of second exhaust gas recirculation regulator 55 or of second exhaust gas recirculation valve 26 is likewise detected in a manner known to those skilled in the art and is indicated by second limiting signal in_limit2.

As a function of its input variables mentioned, module 45 forms a first control deviation RD1 for first exhaust gas recirculation regulator 50 and a second control deviation RD2 for second exhaust gas recirculation regulator 55. First control deviation RD1 is supplied to first exhaust gas recirculation regulator 50. First exhaust gas recirculation regulator 50 forms a first control signal ARK1 for setting the degree of opening of first exhaust gas recirculation valve 25 in such a way that first control deviation RD1 is minimized. First control signal ARK1 is supplied to first exhaust gas recirculation valve 25 for this purpose. Second control deviation RD2 is supplied to second exhaust gas recirculation regulator 55. Second exhaust gas recirculation regulator 55 forms a second control signal ARK2 for setting the degree of opening of second exhaust gas recirculation valve 26 in such a way that second control deviation RD2 is minimized. Second control signal ARK2 is supplied to second exhaust gas recirculation valve 26 for this purpose.

In addition, module 45 is supplied with an information signal select_targets which indicates in the set state that predefined setpoint value m_setpoint should be set for the overall fresh air mass flow as the top target, and which indicates in the reset state that a different control strategy should be used, e.g., setting half of the predefined setpoint value m_setpoint/2 for the overall fresh air mass flow in both air channels 30, 35. The information signal may be fixedly predefined for example, or it may be predefined by the engine controller as a function of the working point of internal combustion engine 1. Information signal select_targets may be reset, for example, during an operating range of high load, e.g., during an acceleration process, in order to achieve equal air mass flows in both air channels 30, 35 as the top target and thus a good response of both turbochargers 5, 10. The same half setpoint value m_setpoint/2 for the overall fresh air mass flow should be set for both air channels for this purpose. In an operating range of low load, e.g., during idling, information signal select_targets may be set in such a way as to set setpoint value m_setpoint for the overall fresh air mass flow as the top target, thereby complying with the emission standard.

Figure 3:
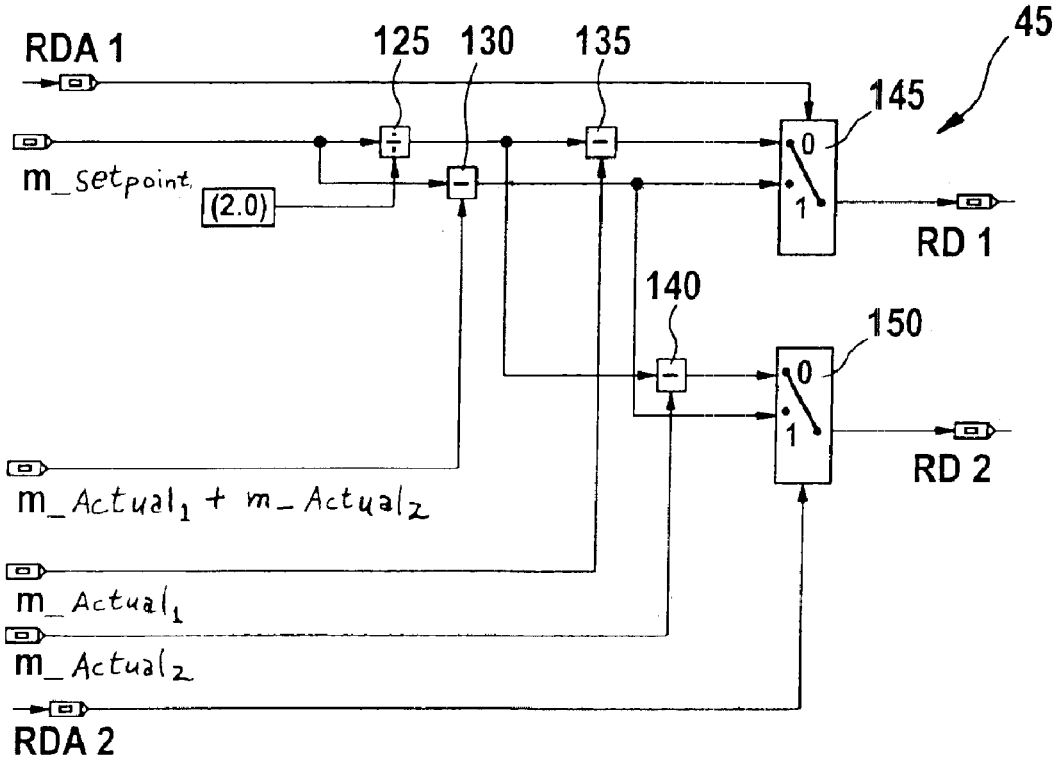
FIG. 3 shows a function diagram for forming the control deviations for the individual exhaust gas recirculation regulations.

FIG. 3 shows a function diagram for implementing module 45 for dividing the control deviations. Setpoint value m_setpoint for the overall fresh air mass flow is supplied to a division element 125 and divided there by value 2.0. The resulting quotient corresponds to half of setpoint value m_setpoint/2 for the overall fresh air mass flow and is reduced by first actual value m_actual1 in a second subtraction element 135. The resulting difference m_setpoint/2−m_actual1 is supplied to a first terminal "0" of a first switch 145. The output of division element 125, i.e., half of setpoint value m_setpoint/2, is additionally reduced by second actual value m_actual2 in a third subtraction element 140. The resulting difference m_setpoint/2−m_actual2 at the output of third subtraction element 140 is supplied to a first terminal "0" of a second switch 150. Sum m_actual1+m_actual2 from both actual values m_actual1, m_actual2, i.e., the actual value of the overall fresh air mass flow formed in an addition element (not shown in FIG. 3), is subtracted from setpoint value m_setpoint for the overall fresh air mass flow, and the resulting difference is supplied to a second terminal "1" of first switch 145, as well as to a second terminal "1" of second switch 150. First switch 145 is activated by a first selection signal RDA1 in order to select one of the two switch positions or terminals "0", "1" of first switch 145. Second switch 150 is activated by a second selection signal in order to select one of the two switch positions or terminals "0", "1" of second switch 150. Depending on the activation, the output of first switch 145 is connected to first terminal "0" or to second terminal "1" and represents first control deviation RD1. Depending on the activation, the output of second switch 150 is connected to first terminal "0" or to second terminal "1" and represents second control deviation RD2.

Figure 4:
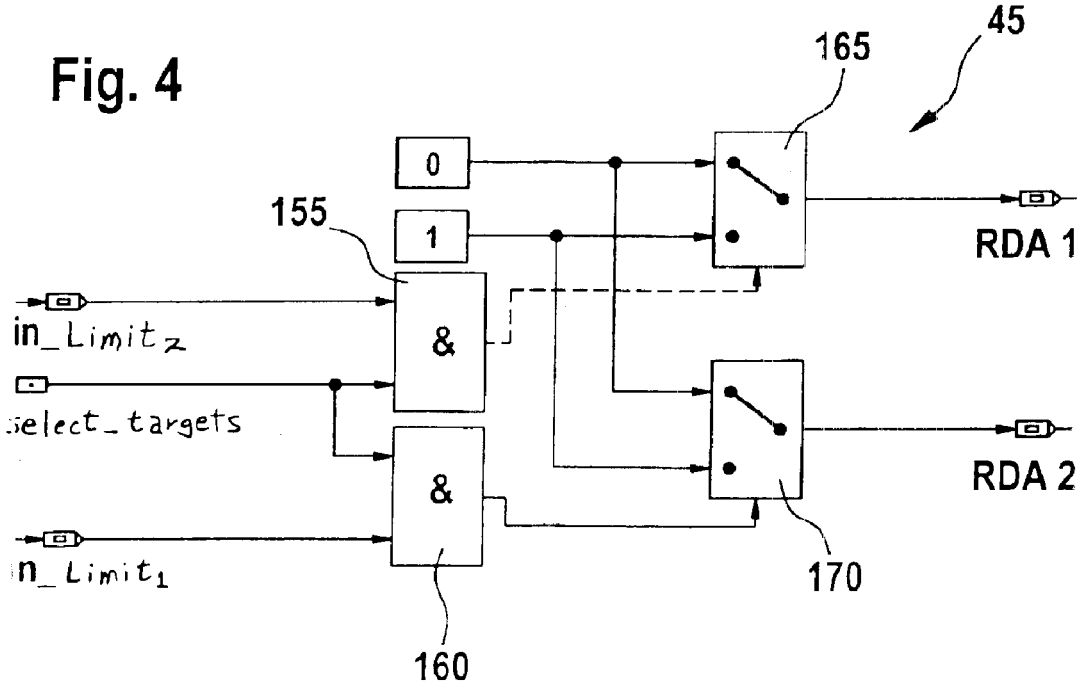
FIG. 4 shows a function diagram for forming selection signals for setting the control deviations.

FIG. 4 shows a function diagram for determining the two selection signals RDA1, RDA2 which is also implemented in module 45 for dividing the control deviations. Second limiting signal in_limit2 and information signal select_targets are supplied to a first AND element 155. The output of first AND element 155 activates a third switch 165 whose output is first selection signal RDA1, and which is set either to "0" or to "1." If first selection signal RDA1 is equal to "0" then it activates first switch 145 according to FIG. 3 in such a way that first control deviation RD1 corresponds to the signal value at first terminal "0" of first switch 145. If first selection signal RDA1 is equal to "1" then it activates switch 145 according to FIG. 3 in such a way that first control deviation RD1 corresponds to the signal value at second terminal "1" of first switch 145. The output of first AND element 155 is set when both inputs of first AND element 155 are set, otherwise it is reset. In the set state, the output of first AND element 155 activates third switch 165 in such a way that first selection signal RDA1 is set to "1." Furthermore, first limiting signal in_limit1 and information signal select_targets are supplied to a second AND element 160. The output of second AND element 160 activates a fourth switch 170 whose output is second selection signal RDA2, and which is set either to "0" or to "1." If second selection signal RDA2 is equal to "0" then it activates second switch 150 according to FIG. 3 in such a way that second control deviation RD2 corresponds to the signal value at first terminal "0" of second switch 150. If second selection signal RDA2 is equal to "1" then it activates second switch 150 according to FIG. 3 in such a way that second control deviation RD2 corresponds to the signal value at second terminal "1" of second switch 150. The output of second AND element 160 is set when both inputs of second AND element 160 are set, otherwise it is reset. In the set state, the output of second AND element 160 activates fourth switch 170 in such a way that second selection signal RDA2 is set to "1."

The mode of operation of the method according to the present invention and of device 40 according to the present invention is described in the following as an example. It is assumed, for example, that information signal select_targets is fixedly predefined and set. Setting setpoint value m_setpoint for the overall fresh air mass flow is thus the top target of both exhaust gas recirculation regulators 50, 55. However, the exhaust gas recirculation regulation is initially performed individually for both air channels 30, 35. Half of setpoint value m_setpoint/2 for the overall fresh air mass flow is predefined as the setpoint value for each of the two exhaust gas recirculation regulators 50, 55. If half of setpoint value m_setpoint/2 for the overall fresh air mass flow is no longer achieved by one of the two air channels 30, 35 because the exhaust gas recirculation regulator of the assigned air channel or the exhaust gas recirculation valve of the assigned exhaust gas recirculation channel are operated in the limiting mode, then the achievement of setpoint value m_setpoint for the overall fresh air mass flow is impressed on the other of the two air channels 30, 35 for the assigned exhaust gas recirculation regulation as the new control target.

With concrete reference to the function diagram in FIG. 4, the overall fresh air mass flow may initially be completely adjusted in air mass equalization. First switch 145 and second switch 150 are connected to first terminal "0," and both exhaust gas recirculation regulators 50, 55 are supplied with half of setpoint value m_setpoint/2 for the overall fresh air mass flow, so that the first control deviation is RD1=m_setpoint/2−m_actual1 and the second control deviation is RD2=m_setpoint/2−m_actual2. If one of the two exhaust gas recirculation regulators 50, 55 or the associated exhaust gas recirculation valve 25, 26 reaches a manipulated variable limit and may thus no longer achieve half of setpoint value m_setpoint/2, the associated switch according to FIG. 3 remaining at first terminal "0," then the other of the two exhaust gas recirculation regulators 50, 55 receives setpoint value m_setpoint for the overall fresh air mass flow minus the actual value for the overall fresh air mass flow as the control deviation, and the associated switch according to FIG. 3 is switched to second terminal "1."

According to an alternative embodiment, it may be additionally or alternatively provided to predefine setpoint value m_setpoint for the overall fresh air mass flow as the setpoint for one or both exhaust gas recirculation regulators 50, 55 in the event that an error at an actuator, e.g., at one of exhaust gas recirculation valves 25, 26, or at a sensor, e.g., at an air mass flow rate sensor, is detected in one of the control loops for the exhaust gas recirculation regulators 50, 55 in a manner known to those skilled in the art. In this case, setpoint value m_setpoint for the overall fresh air mass flow minus the actual value for the overall fresh air mass flow is used for at least one of the two exhaust gas recirculation regulators 50, 55 as the control deviation, and the associated switch according to FIG. 3 is switched to second terminal "1."

A hysteresis characteristic may be applied to the switching operations of the four switches 145, 150, 165, 170 in order to avoid too frequent back and forth switching.

Alternatively to the embodiment of module 45 for dividing the control deviations according to FIGS. 3 and 4, it may be additionally provided that control deviations RD1, RD2 are determined using a characteristics map whose input variables are the input variables of module 45 and whose output variables are control deviations RD1, RD2. The characteristics map may be applied on a test bench for example in such a way that, in the case where both exhaust gas recirculation regulators 50, 55 or both exhaust gas recirculation valves 25, 26 are not operated in the limiting mode, m_setpoint/2−m_actual1 is predefined for first exhaust gas recirculation regulator 50 as first control deviation RD1 and m_setpoint/2−m_actual2 is predefined for second exhaust gas recirculation regulator 55 as second control deviation RD2. In the case where one of the two exhaust gas recirculation regulators 50, 55 or one of both exhaust gas recirculation valves 25, 26 are operated in the limiting mode, m_setpoint−(m_actual1+m_actual2) is predefined as the control deviation for the other of the two exhaust gas recirculation regulators 50,55 or for the exhaust gas recirculation regulator assigned to the other of the two exhaust gas recirculation valves 25, 26.

Furthermore, parametrization of the individual exhaust gas recirculation regulators or parametrization of the controllers used for the individual exhaust gas recirculation regulators may also be performed as a function of the associated control deviation RD1, RD2 selected in module 45 for dividing the control deviations.

The exemplary embodiment has been described on the basis of a dual-flow air system. It may also be applied without any problem, generally and analogously, to a multi-flow air system having a multi-channel air supply and a multi-channel exhaust gas discharge and thus a multi-channel exhaust gas recirculation, a correspondingly proportional setpoint value m_setpoint/n for the overall fresh air mass flow being used in place of half of setpoint value m_setpoint/2 for the overall fresh air mass flow, n being equivalent to the number of air channels and n being greater than or equal to 2. As soon as one of the n exhaust gas recirculation regulators or one of the n exhaust gas recirculation valves is operated in the limiting mode, the remaining exhaust gas recirculation regulators or the exhaust gas recirculation regulators assigned to the remaining exhaust gas recirculation valves are supplied with control deviation m_setpoint−(m_actual1+m_actual2+ . . . +m_actualn). If an error is detected in an actuator or in a sensor in one of the control loops of the exhaust gas recirculation regulators, then all exhaust gas recirculation regulators are supplied with control deviation m_setpoint−(m_actual1+m_actual2+ . . . +m_actualn).

What is claimed is:

1. A method for operating an internal combustion engine having a multi-flow system, including a multi-channel air supply and a corresponding multi-channel exhaust gas discharge, the method comprising:

recirculating exhaust gas from the multi-channel exhaust gas discharge into the multi-channel air supply;

controlling the exhaust gas recirculation for setting a setpoint fresh air mass flow; and predefining a value for a required overall fresh air mass flow of the engine as a setpoint for an exhaust gas recirculation regulation of a selected exhaust gas recirculation channel.

2. The method according to claim 1, wherein the value is predefined when a predefined setpoint for the fresh air mass flow is not achieved in another exhaust gas recirculation channel.

3. A method for operating an internal combustion engine having a multi-flow system, including a multi-channel air supply and a corresponding multi-channel exhaust gas discharge, the method comprising:

recirculating exhaust gas from the multi-channel exhaust gas discharge into the multi-channel air supply;

controlling the exhaust gas recirculation for setting a setpoint fresh air mass flow; and predefining a value for a required overall fresh air mass flow of the engine for at least one exhaust gas recirculation channel as a setpoint for an exhaust gas recirculation regulation, wherein the value is predefined when an error is detected at one of (a) an actuator and (b) a sensor in one control loop for the exhaust gas recirculation regulation.

4. A device for operating an internal combustion engine comprising:

a multi-flow air system including a multi-channel air supply and a corresponding multi-channel exhaust gas discharge;

exhaust gas recirculation channels for recirculating exhaust gas from the multi-channel exhaust gas discharge into the multi-channel air supply; and means for predefining a setpoint value, for predefining a value for a required overall fresh air mass flow of the engine as a setpoint for an exhaust gas recirculation regulation of a selected exhaust gas recirculation channel, the exhaust gas recirculation regulation taking place for setting a setpoint fresh air mass flow.

* * * * *